US010623848B2

(12) United States Patent
Teng

(10) Patent No.: US 10,623,848 B2
(45) Date of Patent: Apr. 14, 2020

(54) PNEUMATIC TWEETER UNIT HAVING IMPROVED SOUND DIAPHRAGM AND STRUCTURE

(71) Applicant: Ko-Chung Teng, Taipei (TW)

(72) Inventor: Ko-Chung Teng, Taipei (TW)

( * ) Notice: Subject to any disclaimer, the term of this patent is extended or adjusted under 35 U.S.C. 154(b) by 25 days.

(21) Appl. No.: 16/061,536

(22) PCT Filed: Dec. 21, 2015

(86) PCT No.: PCT/CN2015/000913
§ 371 (c)(1),
(2) Date: Jun. 12, 2018

(87) PCT Pub. No.: WO2017/106985
PCT Pub. Date: Jun. 29, 2017

(65) Prior Publication Data
US 2019/0289386 A1 Sep. 19, 2019

(51) Int. Cl.
*H04R 9/06* (2006.01)
*H04R 1/10* (2006.01)
(Continued)

(52) U.S. Cl.
CPC ..... *H04R 1/1075* (2013.01); *H04R 7/122* (2013.01); *H04R 7/14* (2013.01); *H04R 7/02* (2013.01);
(Continued)

(58) Field of Classification Search
CPC ... H04R 7/06; H04R 7/10; H04R 7/14; H04R 9/025; H04R 9/047; H04R 9/048; H04R 2307/027
(Continued)

(56) References Cited

U.S. PATENT DOCUMENTS 3,636,278 A * 1/1972 Heil ..... H04R 7/14 381/163
3,829,623 A * 8/1974 Willis ..... H04R 9/02 381/186
(Continued)

FOREIGN PATENT DOCUMENTS

CN 201383869 Y 1/2010
CN 204259145 U 4/2015
(Continued)

*Primary Examiner* — Fan S Tsang
*Assistant Examiner* — Ryan Robinson
(74) *Attorney, Agent, or Firm* — Novick, Kim & Lee, PLLC; Jae Youn Kim

(57) ABSTRACT

Provided is a tweeter unit having an improved sound diaphragm and an integral support frame incorporating a sound diaphragm and a magnet as well as integrating an upper washer and a ring packing. The tweeter unit includes: a base frame; an improved integral support frame, including an upper clamp groove and a lower clamp groove, assembled at the base frame; at least one magnet, assembled in the lower clamp groove; an improved sound diaphragm, assembled in the upper clamp groove; and a sleeve frame, including a plurality of openings and a sleeve portion, and sleeved outside the base frame, the support frame, the at least one magnet and the improved sound diaphragm. The improved sound diaphragm includes a thin film layer and a circuit thin film layer, and the circuit thin film layer is fixed on one side of the thin film layer through an electrolytic bonding layer.

6 Claims, 5 Drawing Sheets

(51) Int. Cl.

| | |
|---|---|
| ***H04R 7/12*** | (2006.01) |
| ***H04R 7/14*** | (2006.01) |
| *H04R 9/02* | (2006.01) |
| *H04R 7/02* | (2006.01) |

(52) U.S. Cl.
CPC ..... *H04R 9/02* (2013.01); *H04R 9/025* (2013.01); *H04R 9/06* (2013.01); *H04R 2209/024* (2013.01); *H04R 2231/003* (2013.01)

(58) Field of Classification Search
USPC ..... 381/399
See application file for complete search history.

(56) References Cited

U.S. PATENT DOCUMENTS 3,898,598 A * 8/1975 Asahi ..... H04R 9/047 381/408
4,056,697 A * 11/1977 Heil ..... H04R 7/14 381/408
5,769,969 A * 6/1998 Ishikawa ..... H01F 1/059 148/301
7,873,178 B2 * 1/2011 Steere ..... H04R 1/06 381/343
8,208,678 B2 * 6/2012 Mundorf ..... H04R 9/048 381/190
8,335,340 B2 * 12/2012 de Haan ..... H04R 9/047 381/398
9,565,498 B2 * 2/2017 Waale ..... H04R 7/08
9,900,696 B2 * 2/2018 Christensen ..... H04R 9/046
9,980,050 B2 * 5/2018 Boyd ..... H04R 7/24
2007/0263894 A1 * 11/2007 Stiles ..... H04R 1/403 381/335
2017/0026726 A1 * 1/2017 Kim ..... H04R 9/06

FOREIGN PATENT DOCUMENTS

| | | | |
|---|---|---|---|
| CN | 205232405 | U | 5/2016 |
| JP | 2009-130666 | A | 6/2009 |
| KR | 10-2011-0048901 | A | 5/2011 |
| TW | M520213 | U | 4/2016 |

* cited by examiner

PNEUMATIC TWEETER UNIT HAVING IMPROVED SOUND DIAPHRAGM AND STRUCTURE

BACKGROUND OF THE INVENTION

Field of the Invention

The present invention relates to a tweeter unit, and more particularly to a pneumatic tweeter unit having an improved sound diaphragm and structure.

Description of the Prior Art

A pneumatic tweeter unit is a structure commonly applied in a high-end loudspeaker, and is sophisticated audio equipment extensively used in the society today. FIG. 1 shows a brief schematic diagram for illustrating a sounding structure in a conventional pneumatic tweeter unit. Referring to FIG. 1, according to a sounding principle of a conventional tweeter unit, a plurality of magnets 2 are placed on a magnetic frame and a sound diaphragm 1 is provided above, wherein the sound diaphragm 1 is a loosely hung in a creased manner on the sound diaphragm frame and is located in the gaps of the plurality of magnets 2. When the tweeter unit is powered up, magnetic forces are exerted to alternatingly press upon the curved and creased sound diaphragm 1 to push away the sound diaphragm 1, and air is compressed along with sound frequencies to generate a sound S. The above design yields a high efficiency, and the powerful magnetic forces on the sound diaphragm 1 are capable of reducing quality reactance or audio-frequency impedance—such design accounts for the origin of the term "pneumatic transformer". It is known from the above description that, in a pneumatic tweeter, a planar sound diaphragm is folded and air is driven according to the principle of compression, and a high efficiency is provided because the amount of air driven is much more than that of a conventional planar diaphragm.

FIG. 2 is a schematic diagram for illustrating a structure of a sound diaphragm in a conventional pneumatic tweeter unit structure, and FIG. 3 is a schematic diagram for illustrating an overall structure of a conventional pneumatic tweeter unit. Referring to both FIG. 2 and FIG. 3, in the above conventional pneumatic tweeter unit structure, the structure of a sound diaphragm 1 includes a conductive aluminum film layer 11, a back adhesive layer 13 and a thin film layer 15, wherein the aluminum film layer 11 is commonly fixed on the thin film layer 15 by using the back adhesive layer 13. Available back adhesive layers 13 in industry all have a certain thickness, such that the above fixing method results in a larger thickness of the overall structure of the pneumatic tweeter unit. On the other hand, the sound diaphragm 1 and the plurality of magnets 2 are respectively secured by a sound diaphragm frame 111 and a magnet frame 113, and are combined through an upper washer 115, a lower washer 117 and a ring packing 119 that are separate and independent units. Accordingly, the overall structure is enlarged and the pneumatic tweeter unit structure cannot be applied in small-size speakers such as earphones. Further, because a sounding structure of common earphones uses a planar diaphragm, a moving coil unit, a balanced armature unit, or a combination of the three types above, such pneumatic tweeter unit structure cannot be applied in small-size structures such as earphones, thus causing limitations on the design of small-size sounding devices and the incapability of further improving the sound quality of earphones.

On the basis of the foregoing reasons, there is a need for a solution for resolving issues of how to reduce the thickness of a sound diaphragm and provide an integrated structure while applying a pneumatic tweeter unit structure in a small-size sounding device such as earphones, so as to enable earphones to achieve more saturated sounds.

SUMMARY OF THE INVENTION

In view of the above issues of the prior art, the present invention primarily provides a pneumatic tweeter sound unit having an improved sound diaphragm and structure, the pneumatic tweeter sound unit including: a base frame; a support frame, including an upper clamp groove and a lower clamp groove, assembled at the base frame; at least one magnet, assembled in the lower clamp groove; an improved sound diaphragm, assembled in the upper clamp groove; and a sleeve frame, including a plurality of openings and a sleeve portion, sleeved outside the base frame, the support frame, the at least one magnet and the improved sound diaphragm. Wherein, the improved sound diaphragm includes a thin film layer and a circuit thin film layer, and the circuit thin film layer is fixed on one side of the thin film layer through an electrolytic bonding layer.

Preferably, the at least one magnet is a grating magnet.

Preferably, the circuit thin film layer is made of a colloid-free copper material.

Preferably, the at least one magnet is rubidium iron.

Preferably, the sound diaphragm is a creased structure.

Preferably, the support frame is an integral support frame.

Preferably, the sleeve frame integrates an upper washer and a ring packing.

Other objects, advantages and features of the present invention can be learned from the description of the detailed embodiments and the accompanying drawings of the present invention below.

DETAILED DESCRIPTION OF THE EMBODIMENTS

Implementation details of the present invention are given with accompanying drawings and component denotations below so as to enable a person skilled in the art to accordingly implement the present invention on the basis of the description of the disclosure.

Figure 1:
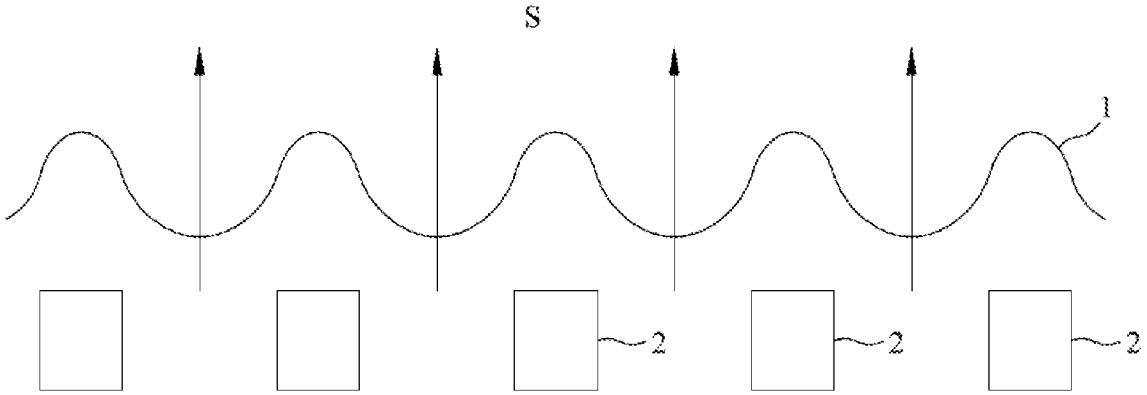
FIG. 1 (PRIOR ART)
FIG. 1 is a brief schematic diagram of a sounding structure in a conventional pneumatic tweeter unit.
Figure 2:
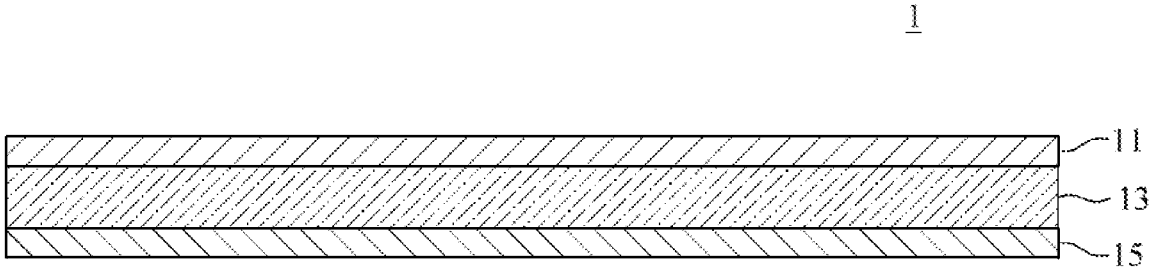
FIG. 2 (PRIOR ART)
FIG. 2 is a schematic diagram of a sound diaphragm in a conventional pneumatic tweeter unit.
Figure 3:
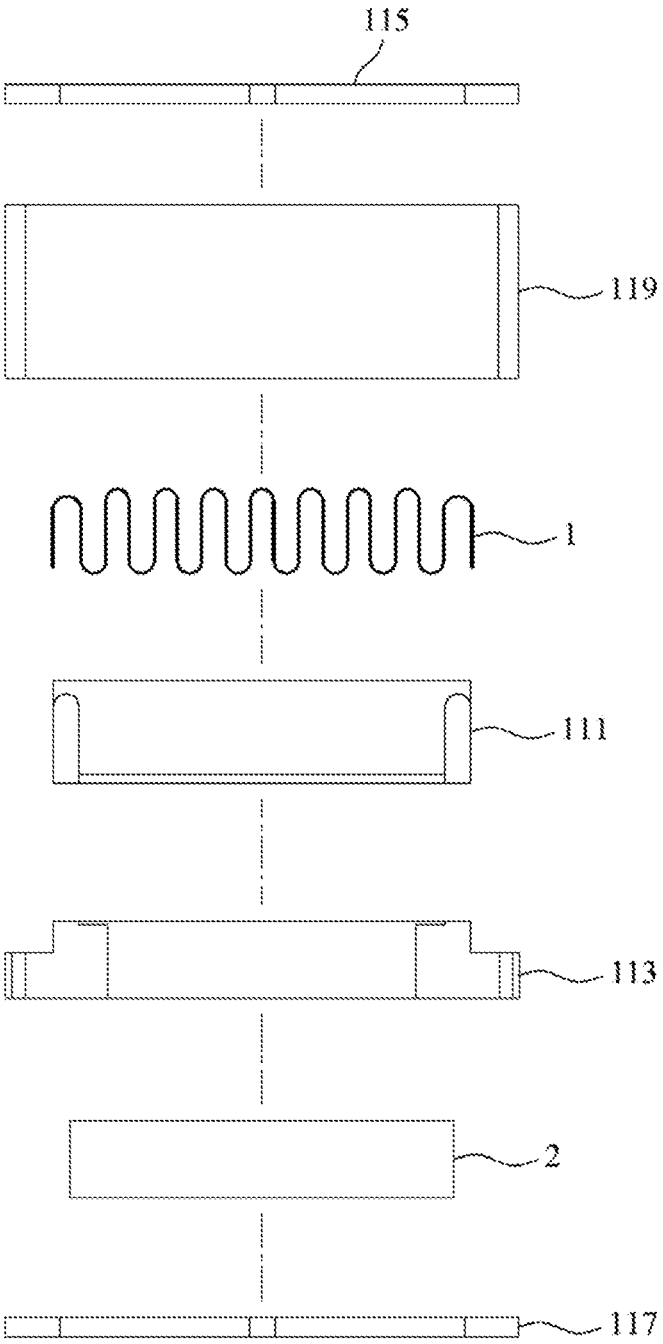
FIG. 3 (PRIOR ART)
FIG. 3 is an overall structure of a conventional pneumatic tweeter unit.
Figure 4:
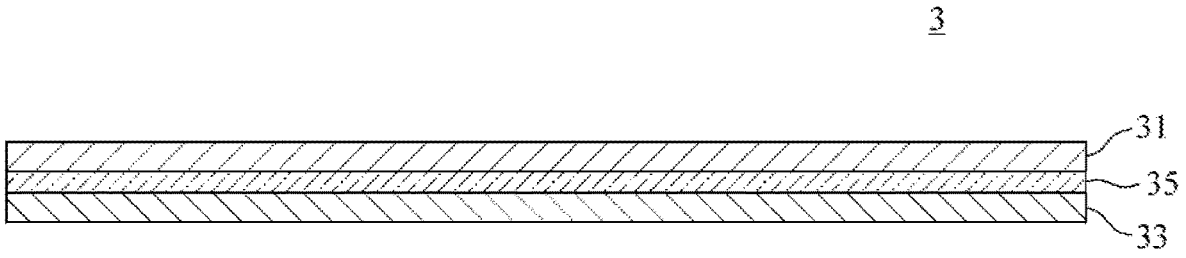
FIG. 4 is a schematic diagram of a structure of an improved sound diaphragm according to a first embodiment of the present invention.

FIG. 4 shows a structure of an improved sound diaphragm according to a first embodiment of the present invention. Referring to FIG. 4, in the description below, a sound diaphragm 3 is represented in leveled and planar state, and the sound diaphragm 3 is however a creased structure in actual applications. The improved sound diaphragm 3 according to the first embodiment of the present invention includes a circuit thin film layer 31 and a thin film layer 33, wherein the circuit thin film layer 31 is fixed on one side of the thin film layer 33 by means of electrolytic bonding. As shown in FIG. 4, the circuit thin film layer 31 is fixed on one side of the thin film layer 33 through an electrolytic bonding layer 35 by means of electrolytic bonding. To provide easy identification, the thickness of the electrolytic bonding layer is not depicted according to an actual ratio, the thickness of an actual electrolytic bonding layer 35 is smaller than the thickness shown in the drawing, and so the presence of the electrolytic bonding layer 35 can be basically neglected. Further, in one embodiment of the present invention, colloid-free copper is adopted as the material of the circuit thin film layer 31. However, in other embodiments, the material of the circuit thin film layer 31 is not limited to colloid-free copper, and any other conductive material that can be fixed on the thin film layer 33 by means of electrolytic bonding can be used as an appropriate material. It is known from FIG. 4 that, the improved sound diaphragm 3 of the present invention includes only the circuit thin film layer 31 and the thin film layer 33. Compared to the conventional sound diaphragm 1 in a three-layered structure including the aluminum film layer 11, the back adhesive layer 13 and the thin film layer 15 in FIG. 2, the improved sound diaphragm 3 of the present invention successfully provides a reduced thickness, and is thus extremely suitable for applications of small-size sounding devices such as earphones.

Figure 5:
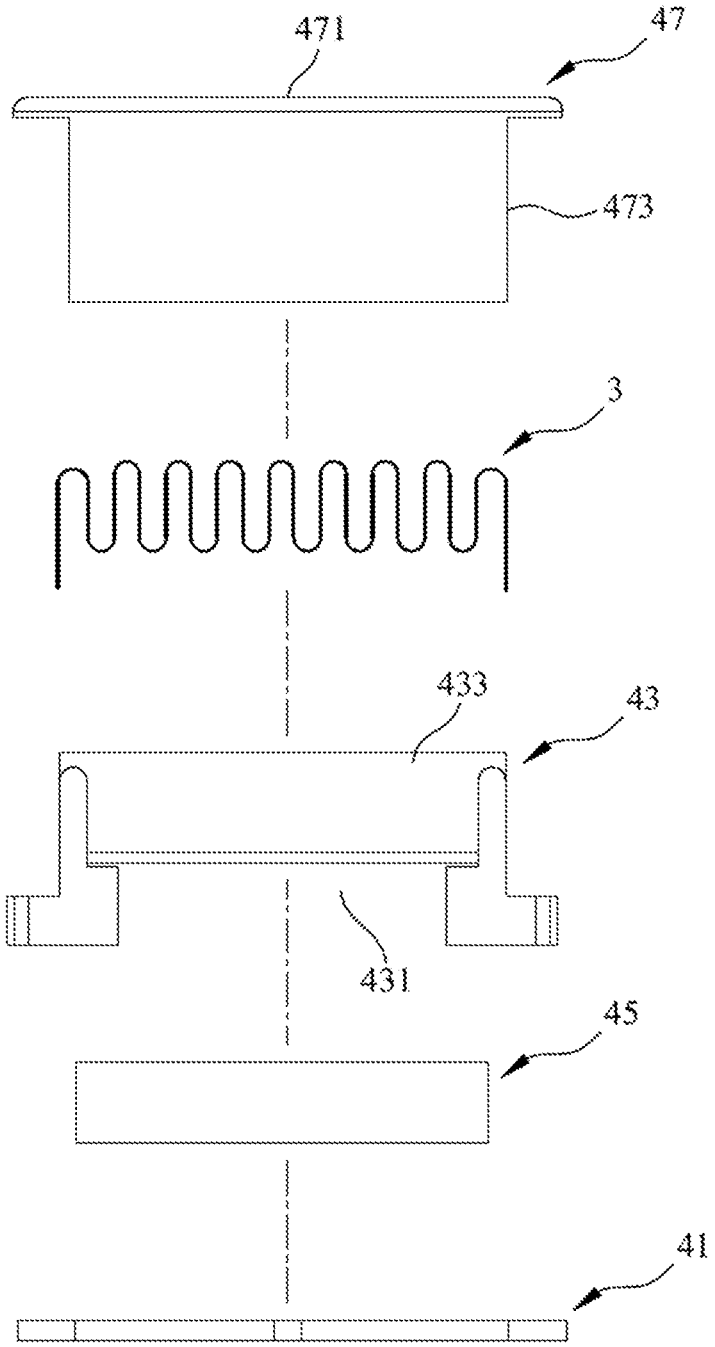
FIG. 5 is a schematic diagram of a pneumatic tweeter unit structure having an improved sound diaphragm and structure according to the first embodiment of the present invention.

FIG. 5 shows a schematic diagram for illustrating a pneumatic tweeter unit structure having an improved sound diaphragm and structure according to the first embodiment of the present invention. Referring to both FIG. 4 and FIG. 5, a pneumatic tweeter unit structure having an improved sound diaphragm and structure according to the first embodiment of the present invention includes: a base frame 41, being a sealed component; an improved integral support frame 43, including an upper clamp groove 433 and a lower clamp groove 431, assembled at the base frame 41; a magnet 45, assembled in the lower clamp groove 431; a creased improved sound diaphragm 3, assembled in the upper clamp groove 433; and a sleeve frame 47, integrating an upper washer and a ring packing, including a plurality of openings 471 and a sleeve portion 473, sleeved around on the above components to combine the same into one body. The improved sound diaphragm 3 includes a circuit thin film layer 31 and a thin film layer 33, and the circuit thin film layer 31 is fixed on one side of the thin film layer 33 through an electrolytic bonding layer 35.

The present invention improves the issue of a conventional sound diaphragm structure having a larger thickness, and the issue that a sound diaphragm and magnets are secured by respective frames and then combined together by an upper washer, a lower washer and a ring packing that are separate and independent units. More specifically, in the present invention, the improved sound diaphragm 3 and the improved integral support frame 43 are installed at the center of the pneumatic tweeter unit having an improved sound diaphragm and structure, and a set of magnets 45 are assembled in the lower clamp groove 431 of the improved integral support frame 43, wherein the magnets 45 are a grating magnet consisting of a plurality of long strip-shaped magnets, the grating magnet is installed in the lower clamp groove 431, and the installed grating magnet has gaps. Thus, when the pneumatic tweeter unit having an improved sound diaphragm and structure is powered up, magnetic forces are exerted to alternatingly pressed upon the creased improved sound diaphragm 3 to push away the improved sound diaphragm 3, and air is compressed along with sound frequencies to generate sounds that then pass through the openings 471 to an exterior. Such design provides an extremely high efficiency and has a smaller size, and the powerful magnetic forces of the improved sound diaphragm 3 are capable of reducing quality reactance or audio-frequency impedance.

Next, the base frame 41 is assembled below the improved integral support frame 43, and the sleeve frame 47 is stacked on the support frame 43. The plurality of openings 471 on the sleeve frame 47 are strip-shaped openings, which have a direction parallel to the direction of the grating magnet, so as to allow sounds to pass without obstruction through the openings 471 to the exterior. The sleeve portion 473 of the sleeve frame 47 is then sleeved outside all of the above assembled components, and a colloidal sol is then used for adherence and fixation to complete the present invention. The components are fixed by a colloidal sol here for example, and the present invention is not limited thereto. For example, other assembly means such as screws and bolts can also be used to combine and fix the components. Further, in one embodiment of the present invention, the magnets 45 are rubidium iron.

Figure 6:
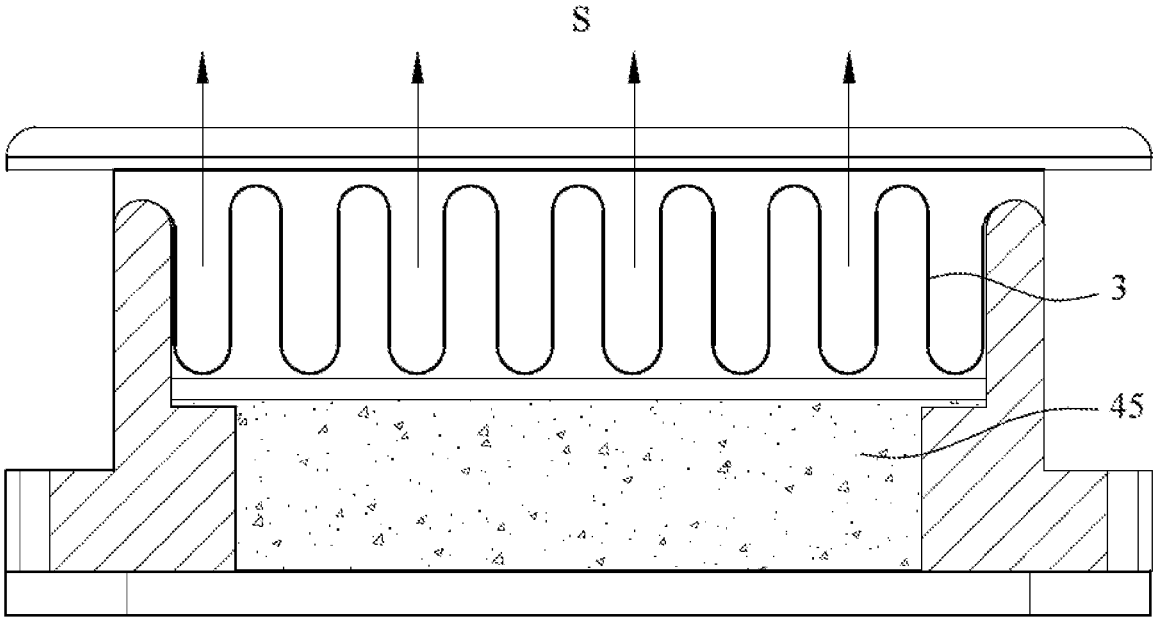
FIG. 6 is a schematic diagram of a sounding structure in a pneumatic tweeter unit structure having an improved sound diaphragm and structure according to the first embodiment of the present invention.

FIG. 6 is a schematic diagram for illustrating a sounding structure in a pneumatic tweeter unit having an improved sound diaphragm and structure according to the first embodiment of the present invention. Referring to FIG. 4, FIG. 5 and FIG. 6, the center part is the creased improved sound diaphragm 3 on the improved integral support frame 43, and the magnet 45 below the improved sound diaphragm 3 is the grating magnet. When the pneumatic tweeter unit having an improved sound diaphragm and structure is powered up, magnetic forces are exerted to alternatingly press upon the creased improved sound diaphragm 3 to push away the improved sound diaphragm 3, such that air is compressed along with sound frequencies to generate sounds that then pass through the openings 471 to the exterior, wherein the generated sounds S reach the exterior from above. The design of the present invention has an extremely high efficiency and a smaller size, and the powerful magnetic forces on the improved sound diaphragm 3 are capable of reducing quality reactance or audio-frequency impedance.

It is known from the above disclosure that, in the improved sound diaphragm provided by the present invention, the circuit thin film layer formed by colloid-free copper is fixed on one side of the thin film layer by means of electrolytic bonding, thus significantly reducing the overall thickness of the improved sound diaphragm. Further, the present invention includes the improved integral support frame and a highly integrated external structure. As such, the pneumatic tweeter unit having an improved sound diaphragm and structure of the present invention can be installed in a small-size sounding device such as earphones. Moreover, when the pneumatic tweeter unit having an improved sound diaphragm and structure of the present invention is installed in a small-size sounding device such as earphones, because the principle according to which the present invention generates sounds is a pneumatic principle that is different from the principle of conventional planar diaphragm earphones, the present invention enables earphones to generate more saturated sounds having a better quality.

The above description is for explaining preferred embodiments of the present invention and is not to be construed as limitations to the present invention. Therefore, any modifications or variations made on the basis of the same spirit of the present invention are to be encompassed within the intended scope of the present invention.

What is claimed is:

1. A pneumatic tweeter unit having an improved sound diaphragm and structure, comprising:

a base frame;

a support frame, comprising an upper clamp groove and a lower clamp groove, assembled at the base frame;

at least one magnet, assembled in the lower clamp groove;

an improved sound diaphragm, assembled in the upper clamp groove; and a sleeve frame, comprising a plurality of openings and a sleeve portion, sleeved outside the base frame, the support frame, the at least one magnet and the improved sound diaphragm, wherein, the improved sound diaphragm comprises a thin film layer and a circuit thin film layer, and the circuit thin film layer is fixed on one side of the thin film layer through an electrolytic bonding layer, wherein the at least one magnet is a grating magnet, and wherein the plurality of openings on the sleeve frame are strip-shaped openings, which have a direction parallel to the direction of the grating magnet.

2. The pneumatic tweeter unit according to claim 1, wherein the circuit thin film layer is made of a colloid-free copper material.

3. The pneumatic tweeter unit according to claim 1, wherein the at least one magnet is rubidium iron.

4. The pneumatic tweeter unit according to claim 1, wherein the improved sound diaphragm is a creased structure.

5. The pneumatic tweeter unit according to claim 1, wherein the sleeve frame integrates an upper washer and a ring packing.

6. The pneumatic tweeter unit according to claim 1, wherein the support frame is an integral support frame.

* * * * *